United States Patent [19]

Ramirez

[11] Patent Number: 4,960,028

[45] Date of Patent: Oct. 2, 1990

[54] QUICK-RELEASE CYMEAL MOUNTING FASTENER

[76] Inventor: Anthony Ramirez, 804 Fern St., Escondido, Calif. 92027

[21] Appl. No.: 405,196

[22] Filed: Sep. 11, 1989

[51] Int. Cl.[5] ..... G10G 5/00

[52] U.S. Cl. ..... 84/421; 84/422.3

[58] Field of Search ..... 84/402 A, 421, 422.3

[56] References Cited

U.S. PATENT DOCUMENTS

| | | | |
|---|---|---|---|
| 3,336,827 | 8/1967 | Gaylor | 84/422.3 |
| 4,458,574 | 7/1984 | Hoshino | 84/422.3 |
| 4,526,083 | 7/1985 | Le Mert | 84/421 |

FOREIGN PATENT DOCUMENTS

| | | | |
|---|---|---|---|
| 3000536 | 7/1981 | Fed. Rep. of Germany | 84/422.3 |
| 3441204 | 5/1986 | Fed. Rep. of Germany | 84/421 |
| 590709 | 7/1947 | United Kingdom | 84/422.3 |

*Primary Examiner*—Lawrence R. Franklin

*Attorney, Agent, or Firm*—John J. Murphey

[57] ABSTRACT

A fastener for quick-mounting a cymbal to an upright cymbal support rod comprising a pair of half-round sleeve members arranged in face-to-face relationship forming a cylindrical surface therebetween for grasping the cymbal mounting rod; a tab extending upward from each sleeve member including means for pivoting said members near said tabs so that, by squeezing said tabs together, said sleeve members are pivoted away from each other; a pair of split flange members, one attached to the lower end of each sleeve member, spaced apart from said tab, arranged in co-planar alignment when said members are in adjacent contact to form a planar compression surface for pressing toward a cymbal placed on the cymbal mounting rod; and, means for biasing said sleeve members into full contact about the cymbal mounting rod threaded end to hold the cymbal on the rod.

15 Claims, 3 Drawing Sheets

QUICK-RELEASE CYMEAL MOUNTING FASTENER

BACKGROUND OF THE INVENTION

1. Field of the Invention

This invention pertains to the field of fastening devices. More particularly, this invention concerns releasable fastening devices specially useful in temporarily securing a cymbal on a mounting shaft.

2. Description of the Prior Art

Cymbals are musical instruments that require firm support during use. They are generally large, disk-shaped slightly concave objects made of bronze or brass and range in outside diameter from as small as three inches to as large as thirty inches or more and vary in thickness and weight so as to provide a substantial range of sound. Virtually all cymbals have a center mounting hole ranging in diameter from one-half to nine-sixteenths of an inch for placement over a cymbal-mounting rod that is generally associated with a music stand or other support structure.

When playing the cymbals, the musician strikes them with sticks or brushes and such effort often causes the cymbal to swing wildly about its center mounting hole. If not adequately secured, the cymbal could to bounce off the mounting shaft and fall to the floor causing a substantial amount of disconcerting noise as well as the potential for injury to person and property.

Most cymbals are retained on cymbal-mounting shafts with wing nuts that are twisted down over the threaded shaft end. The use of wing nuts while adequate to hold the cymbal on the shaft takes far too much time to accommodate the rapid change needed for many musical arrangement. In addition, the twisting, by hand, of steel wing nuts against a bronze or brass surface raises the potential of causing scratches in the surface that may create unwanted changes in the tone of the cymbal. In addition, the use of wing nuts causes a person's hands to contact the cymbals where body acids and oils attack the surface finish of the cymbals. Still further, the diameter and thread size of the cymbal mounting shafts vary with the manufacturer and therefore the user is required to carry with him or her a wide variety of wing nuts that increase the cost of utilization of such mounting techniques.

Some advances have been made in this prior art. U.S. Pat. Nos. 3,994,198; 4,122,750; 4,216,695; 4,319,514 and 4,365,535 all show various fixtures that have been developed for use in temporarily retaining a cymbal on a cymbal-mounting shaft. All of these devices are made of metal and contain highly engineered parts that are costly to manufacture and are subject to breakage. In addition, these devices involve the use of metals that have the same potential for causing damage as the wing nuts previously described. Further, these patented devices, being of metal, in many respects bear against the cymbal thus causing unwanted changes in its sound. Some of the patented devices are usable with threaded shafts and some are not so that more than one type of patented device must be carried with the individual in order to facilitate utilization with all of the various types of cymbal mounting rods used in the profession.

Accordingly, there still remains a need in the industry for a quick-release fastener that is usable with a wide variety of cymbal mounting shafts, both threaded and unthreaded, of varying diameters, and that have threads of various sizes and thicknesses; a device that will not damage the surface of the cymbal and that may be placed against the cymbal without causing an unwanted change in the sound of the cymbal; a device that is inexpensive to produce and that may be used with a wide variety of different cymbals and cymbal mounting shafts.

SUMMARY OF THE INVENTION

The present invention is a novel quick-release fastener for use in retaining a cymbal on a cymbal support rod or mounting shaft that satisfies all of the above-described needs of the prior art. The invention is a unique combination of half-round non-metal sleeve members having tabs extending upward from one end and a pair of split flanges at the other end wherein the sleeve members are pivotally connected so that by squeezing the tabs together, the sleeve members are forced apart and wherein means are provided for biasing the sleeve members into close contact with the cymbal mounting rod.

This invention is a quick-disconnect fastener actuated by merely squeezing the tabs together to force the sleeve members apart and lifting the fastener from the cymbal-mounting rod. Because of the non-metal nature of the fastener, it may be used on a wide variety of cymbal mounting rod diameters. Further, the threaded inner surface of the sleeve members conform easily to the wide variety of shaft threads and accordingly hold the cymbal tightly on the mounting shaft. In another embodiment a soft elastomeric liner is fastened along the inside surface of the sleeve members to conform to any type of threads o the cymbal mounting rod. The tabs are placed at the upper end of the fastener so that it may be placed over the cymbal onto the mounting shaft without contact between the user's hands and the cymbal thus reducing the potential for damage to the finish thereof. Still further, this invention is inexpensive to manufacture and is preferably made of inexpensive plastic, as opposed to hard metal, and is very quick and easy to use.

Accordingly, the main object of this invention is a quick-release fastener for use in securing a cymbal onto a cymbal-mounting shaft wherein the fastener is made of non-metal material so as not to scratch or damage the finish or surface of the cymbal; other objects include a device that is utilized over a wide variety of diameters of cymbal mounting shafts and usable with a wide variety of sizes and shapes of shaft mounting threads, a device that is noiseless because of its non-metal construction, is inexpensive and amenable for use over a wide variety of cymbals of various sizes and shapes.

These and other objects of the invention will become more apparent when one reads the description of the preferred embodiment taken together with the drawings attached hereto. The scope and extent of the proprietary rights desired by the patentee may be gleaned from a fair reading of the claims that conclude this specification.

DESCRIPTION OF THE PREFERRED EMBODIMENT

Figure 1:
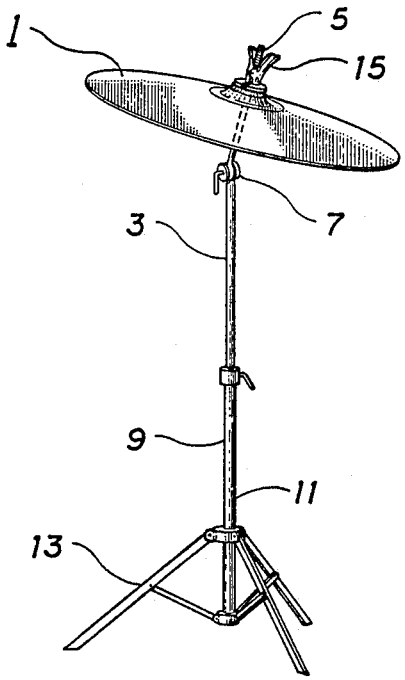
FIG. 1 is an illustrative view of a typical cymbal mounted on a typical cymbal support showing the cymbal mounting shaft at the top thereof and one embodiment of this invention utilized to hold the cymbal on the shaft.

FIG. 1 shows a typical configuration of a cymbal 1 supported for use on a support rod 3, said rod'an upwardly directed threaded mounting end 5 connected thereto through a universal fitting 7, all of these components supported by a musical stand 9 that comprises an upright support tube 11 positioned over a multi-legged base 13. Cymbal 1 is shown secured on a rod end 5 by one embodiment 15 of this invention.

Figure 2:
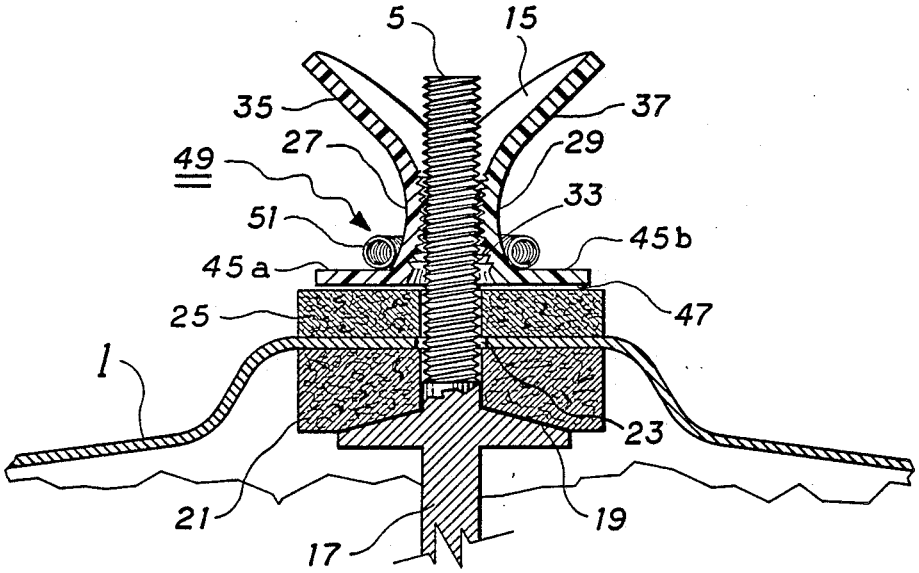
FIG. 2 is a side elevational, partly sectional plan view of another typical configuration of a cymbal on a stand showing the preferred embodiment of this invention utilized in holding the cymbal on the mounting rod.

FIG. 2 shows another embodiment of threaded rod end 5 showing it to be extending upward from a support anvil 17, for attachment to universal fitting 7, said anvil having a broad support surface 19 formed thereon. A first thick felt support washer 21 is centered over shaft 5, supported by surface 19, over which is placed cymbal 1 at its centered mounting hole 23. A second thick felt cover washer 25 is normally placed over cymbal 1. The purposes of washers 21 and 25 are to protect the cymbal surfaces from contact with metal support surface 19 and also to isolate the cymbal between fastener 15 and the rest of the music stand to prevent a change in the noise made by the cymbal.

As shown in FIGS. 2 through 5, this invention comprises a pair of half-round sleeve members 27 and 29, arranged in face-to-face relationship to form a cylindrical surface 31 therebetween for grasping the surface 33 of rod 5. It is preferred that sleeve members 27 and 29 are made of plastic so that surface 33 is slightly deformable so as to conform to the outline of rod surface 31 should it have threads cut therein as shown in FIG. 2.

Figure 4:
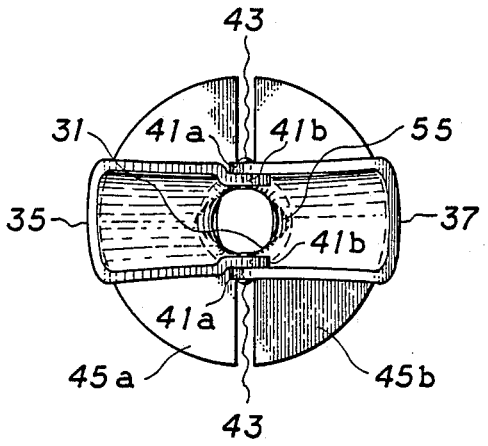
FIG. 4 is a top plan view of the embodiment shown in FIG. 3.
Figure 3:
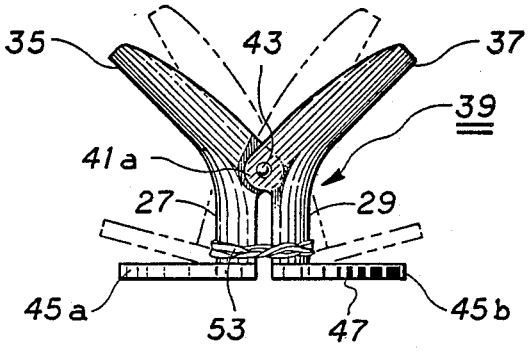
FIG. 3 is a side elevational view of the preferred embodiment shown in FIG. 2 showing, in dotted outline, how the tabs may be squeezed together to separate the sleeve members for removal of the fastener from the cymbal mounting shaft.
Figure 5:
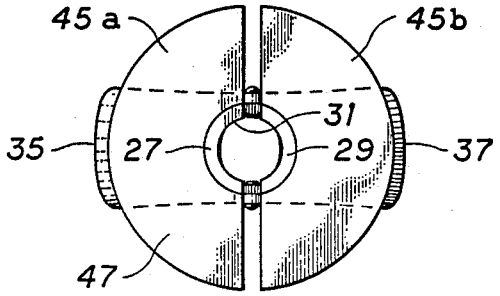
FIG. 5 is a bottom plan view of the embodiment shown in FIG. 3.

Tabs 35 and 37, extend from sleeve members 27 and 29 with tab 35 extending from sleeve 27 and tab 37 extending from sleeve 29. It is preferred that tabs 35 and 37 also extend outward from each other to facilitate there being later pinched together as shown in dotted outline in FIG. 3. Means 39 is provided for pivoting sleeve members 27 and 29 apart when tabs 35 and 37 are squeezed together. As shown in FIGS. 3 and 4, means 39 comprises a pair of overlapped tabs **41*a* and 41*b* extending from the sides of sleeve members 27 and 29 across each other, and pinned together with a pair of spaced-apart pivot pins 43 on both sides of members 27 and 29. Other forms of pivoting members 27 and 29** are available as known in the prior art and are fully contemplated in this invention.

A pair of C-shaped split flange members **45*a* and 45*b*, preferably shaped as half circles, are attached to the lower ends of sleeve members 27 and 29 respectively and are joined thereto by gluing or other known processes including being made as one monolithic unit as shown in FIG. 1. Flange members 45*a* and 45*b* are arranged in co-planar alignment, i.e., in the same plane, when members 27 and 29 are in adjacent contact. Flange members 45*a* and 45*b* form a planar compression surface 47 for use in bearing against cymbal 1 or against felt cover washer 25 that is forced against cymbal 1 when cymbal 1 is operably positioned on threaded rod end 5. The purpose of planar compression surface 47 is to aid in stabilizing cymbal 1 in a neutral or level position on threaded rod end 5 and resist wild pitching or movement when the cymbal 1** is struck by a drum stick or brush.

Figure 6:
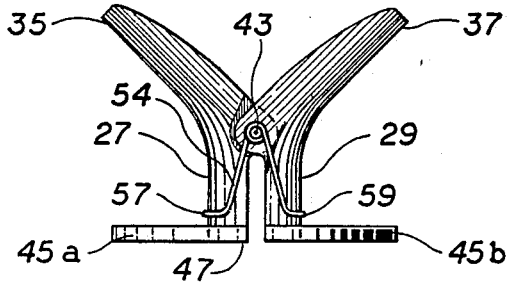
FIG. 6 is a side view, partially in section, showing another embodiment of the invention.

Means 49 is provided for biasing sleeve members 27 and 29 into full contact along their total length about cymbal mounting rod end 5. As shown in FIG. 2, means 49 means 49 may take the simplified form of a coil spring 51 wrapped around the outside circumference of sleeve members 27 and 29 near their lower ends. In FIG. 3, means 49 is shown to be in the form of rubber band 53 stretched and/or wound numerous times around the outside circumference of sleeve members 27 and 29 near the lower sleeve ends. Another form of means 49 is shown in FIG. 6 as a wire spring 54 coiled about pin 43 having portions thereof engaging one sleeve member and the other tab at points 57 and 59 respectively. Other forms of means 49 are contemplated in this invention.

A series of ribs 55 is formed along inner surface 31 of sleeve members 27 and 29 and extends along the length thereof, as shown in FIG. 4, to enhance the ability of sleeve members 27 and 29 to tightly clutch the threaded surface of threaded mounting rod end 5. It is further preferred that ribs 55 take the form of threads such as the threads on mounting rod end 5 to even further aid in holding fastener 15 down on cymbal 1.

Figure 7:
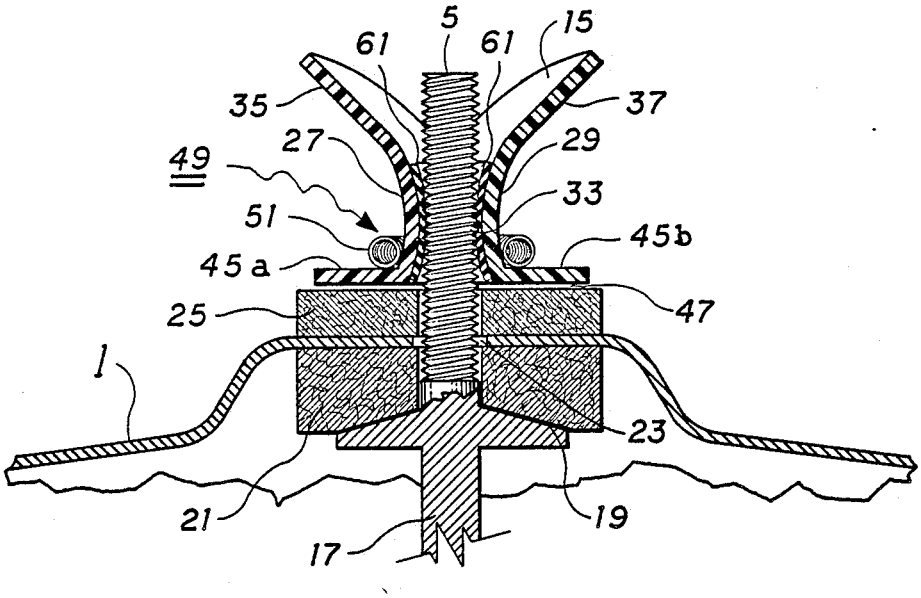
FIG. 7 is a side elevational, partly sectional plan view of another embodiment of this invention.

As shown in FIG. 7, another embodiment of this invention includes a layer 61 of flexible material, such as elastomeric foam, attached to cylindrical surface 31, such as by gluing, to form a yieldable surface for squeezing against rod surface 31. By this means the fastener may be utilized with a wide range of sizes of threads that are cut or formed in rod surface 31.

What is claimed is:

1. In a cymbal mounting arrangement, including a cymbal rod having an upwardly directed threaded end, for receipt thereover of a cymbal, the improvement comprising a quick-release fastener to retain the cymbal on the rod, the fastener comprising:

(a) a pair of half-round sleeve members arranged in face-to-face relationship forming a cylindrical surface therebetween for grasping the cymbal mounting rod;

(b) a tab extending upward from each sleeve member including means for pivoting said members near said tabs so that, by squeezing said tabs together, said sleeve members are pivoted away from each other;

(c) pair of split flange members, one attached to the lower end of each sleeve member, spaced apart from said tab, arranged in co-planar alignment when said members are in adjacent contact to form a planar compression surface for pressing toward a cymbal placed on the cymbal mounting rod; and, (d) means for biasing said sleeve members into full contact about the cymbal mounting rod threaded end to hold the cymbal on the rod.

2. The fastener of claim 1 where a series of ribs are formed on said cylindrical surface to aid in grasping the threads on the cymbal mounting rod end.

3. The fastener of claim 2 wherein said ribs are formed as threads of similar size and shape to the threads on the mounting rod end.

4. The fastener of claim 1 wherein said tabs extend outward from each other as they extend upward from each sleeve.

5. The fastener of claim 1 wherein said means for pivoting said members includes separate hinges in spaced-apart arrangement to allow passage therealong of the cymbal mounting rod.

6. The fastener of claim 1 wherein said split flange members form a circular enclosure when placed in adjacent contact.

7. The fastener of claim 1 wherein said means for biasing said sleeve members into full contact include a rubber band stretched about the outside circumference of said sleeve members.

8. The fastener of claim 1 wherein said means for biasing said sleeve members into full contact include a coil spring stretched about the outside circumference of said sleeve members.

9. The fastener Of claim 1 wherein said means for biasing said sleeve members into full contact include a wire spring coiled about said means for pivoting said members and having the ends of said spring in contact with said sleeve members.

10. The cymbal mounting arrangement of claim 1 wherein said sleeves and flange members are made of plastic.

11. The cymbal mounting arrangement of claim 1 further including n layer of flexible material attached to said cylindrical surface to form a yieldable surface to squeeze against the threads on said cymbal mounting rod.

12. In a cymbal mounting arrangement, including a cymbal rod having an upwardly directed threaded end, for receipt thereover of a cymbal, the improvement comprising a plastic quick-release fastener to retain the cymbal on the rod, regardless of the diameter of the rod, the fastener comprising:

(a) a pair of half-round sleeve members arranged in face-to-face relationship forming a cylindrical surface therebetween for grasping the cymbal mounting rod;

(b) a series of ribs formed on said cylindrical surface to aid in grasping the threads on the cymbal mounting rod end;

(c) a tab extending upward and outward from each sleeve member including means for pivoting said members including separate hinges in spaced-apart arrangement extending from said sleeves so that, by squeezing said tabs together, said sleeve members are pivoted away from each other;

(d) a pair of split flange members, forming a full circular member when placed in adjacent contact, one attached to each sleeve member, spaced apart from said tab, arranged in co-planar alignment when said members are in adjacent contact to form a planar compression surface to bear against a cymbal placed on the cymbal mounting rod; and, (e) means for biasing said sleeve members, into full contact about the cymbal mounting rod threaded end to hold the cymbal on the rod.

13. The fastener of claim 12 wherein said means for biasing said sleeve members into full contact include a rubber band stretched about the outside circumference of said sleeve members.

14. The fastener of claim 12 wherein said means for biasing said sleeve members into full contact include a coil spring stretched about the outside circumference of said sleeve members.

15. The fastener of claim 12 wherein said means for biasing said sleeve members into full contact include a wire spring coiled about said means for pivoting said members and having the ends of said spring in contact with said sleeve members.

* * * * *

UNITED STATES PATENT AND TRADEMARK OFFICE

CERTIFICATE OF CORRECTION

PATENT NO. : 4,960,028

DATED : October 2, 1990

INVENTOR(S) : Anthony Ramirez

It is certified that error appears in the above-identified patent and that said Letters Patent is hereby corrected as shown below:

On the title page item 54 and in column 1, lines 1-3, the title of the invention should read --QUICK -RELEASE CYMBAL MOUNTING FASTENER--

Signed and Sealed this

Thirty-first Day of December, 1991

*Attest:*

HARRY F. MANBECK, JR.

*Attesting Officer*

*Commissioner of Patents and Trademarks*